United States Patent [19]

Bruder et al.

[11] Patent Number: 4,972,745

[45] Date of Patent: Nov. 27, 1990

[54] METHOD AND APPARATUS FOR CUTTING BLANKS FROM WEBS OF MATERIAL

[75] Inventors: Wolfgang Bruder, Bielefeld; Klaus Biervert, Spenge; Jürgen Meybrink, Gutersloh, all of Fed. Rep. of Germany

[73] Assignee: Durkopp System Technik GmbH, Fed. Rep. of Germany

[21] Appl. No.: 274,460

[22] Filed: Nov. 21, 1988

[30] Foreign Application Priority Data

Nov. 19, 1987 [DE] Fed. Rep. of Germany ..... 3739201

[51] Int. Cl.[5] ..... B26D 7/06

[52] U.S. Cl. ..... 83/422; 83/277; 83/650; 83/936; 242/58.6; 242/79

[58] Field of Search ..... 83/52, 925 CC; 242/58.6, 79

[56] References Cited

U.S. PATENT DOCUMENTS

| | | | |
|---|---|---|---|
| 3,393,881 | 7/1968 | Nash | 242/79 |
| 3,438,593 | 4/1969 | Reed | 242/79 |
| 3,695,539 | 10/1972 | Lindstaedt | 242/58.6 |
| 3,769,488 | 10/1973 | Hasslinger | 83/925 CC |
| 4,176,566 | 12/1979 | Patterson et al. | 83/925 CC |
| 4,328,726 | 5/1982 | Pearl | 83/925 CC |
| 4,386,741 | 6/1983 | Weiss et al. | 242/58.6 |
| 4,703,901 | 11/1987 | Stauber | 242/79 |

FOREIGN PATENT DOCUMENTS

| | | |
|---|---|---|
| 8804614.1 | 6/1988 | Fed. Rep. of Germany . |
| 7335534 | 5/1975 | France . |

*Primary Examiner*—Douglas D. Watts
*Assistant Examiner*—Hwei-siu Payer
*Attorney, Agent, or Firm*—Ostrolenk, Faber, Gerb & Soffen

[57] ABSTRACT

A method for cutting blanks from webs of material, in which the blanks which are longer than the cutting table are only partially cut out at a cutting station. Then, after advance of the following segment or partial segments of the web to the cutting station, the blanks are then separated completely from the web.

5 Claims, 5 Drawing Sheets

METHOD AND APPARATUS FOR CUTTING BLANKS FROM WEBS OF MATERIAL

BACKGROUND OF THE INVENTION

1. Field of the Invention

The present invention relates to a method and apparatus for cutting blanks from webs of material which are moved across a cutting region and cut by cutting means. More particularly, the method and apparatus permit the cutting out of patterns that cannot be fully accommodated within the cutting region during any single cutting step.

2. Background Art

In the past, in order to cut materials, for instance textiles, layers (sheets) of material had to be provided having at least the same length as the corresponding pattern to be cut out. In the clothing industry one works predominantly with a layer length (or cutting pattern length) of 4 to 7 meters, from which different patterns are then cut. In the upholstered furniture industry, layer lengths up to 15 meters are customary. The material layers, for example fabric layers, are laid out on pallets outside the cutting table by hand or by means of a laying machine. Then one individual pallet is placed on the cutting table and the cutting is effected by hand-guided cutting knives or an automatic cutting device (for instance a water-jet or laser-beam cutting device).

With this method the maximum possible cutting-pattern length is limited by the length of the cutting table.

For longer lengths it is known to provide rotating brushes on the cutting table which can transport a correspondingly longer pallet over the cutting table or through the actual cutting region.

It is quite common also to place several layers one on top of the other and cut them in one operation.

With both methods the fact must be borne in mind that the specific layer lengths must be longer, by a certain margin of safety (customarily 3 to 5 cm), than the length of the contours to be cut out. This is important in order to obtain a clean cutting line at the end of each individual contour, and furthermore to be able to take into account possible tolerances in connection with the placement of the individual layers on the pallets or the adjustment of the cutting tool.

Both methods have the disadvantage that long cycle times result from the placement of the layers on the pallets outside the cutting region. Also, the required margins of safety in each layer result, in general, in a large amount of waste. This not only increases the cost of manufacture but also, depending on the nature of the material used, results in some degree of pollution of the environment when the waste is disposed of.

Federal Republic of Germany AS 2,301,736 discloses an apparatus for cutting flat material with which a more streamlined manner of operation is possible. However, the method of cutting to be carried out with this apparatus has the disadvantage that the web of material is pushed forward by constant, identical distances regardless of the contour of the blank which is to be cut out. As a result, the machine has a long cycle time and a very great length.

Federal Republic of Germany OS 3,530,886 discloses a method for the automatic cutting of materials from a web of material. For this purpose there is used a cutting table having a cutting-material resting surface which is developed in brushlike manner and as an endless conveyor belt. The web of material, which can be withdrawn from a roll, is held on the cutting-material resting surface by a vacuum and cut. After a given length of cut has been effected, the cutting-material resting surface is transported further until the patterns which have been cut out can be removed.

This method can only be employed if the contour to be cut out is not larger than the distance from the place of cutting to the end of the cutting table. Furthermore, because the material is held by a vacuum, only a single-layer cut can be effected, which results not only in long cycle times but also in long setup times.

All prior art materials mentioned in this patent disclosure are expressly incorporated by reference.

SUMMARY OF THE INVENTION

In view of the foregoing, the general object of the present invention is to provide a method for cutting blanks from webs of material which requires only a short cycle time and which furthermore makes it possible to dispense with substantial safety margins in connection with the individual layers, as well as to provide an apparatus for carrying out this method.

By the method of the invention it is possible to cut even complicated contours which are of greater length than the cutting surface available. Furthermore, no safety margin is necessary for the last cut to be carried out.

With the apparatus it is also possible to cut the contour in multiple layers. Furthermore the desired layer thickness can be adjusted rapidly and in a simple manner. The replacement of empty material rolls is also easily effected, since the rolls are always inserted at the same place. In this way, the result is obtained that a new web of material is always present at the uppermost position, regardless of how many layers are cut. In addition to the simplicity in handling, this also results in short setup times.

BRIEF DESCRIPTION OF THE DRAWINGS

Other objects, features and advantages will be understood from the following detailed description of embodiments thereof, with reference to the drawings, in which.

DETAILED DESCRIPTION OF THE EMBODIMENTS

Figure 1:
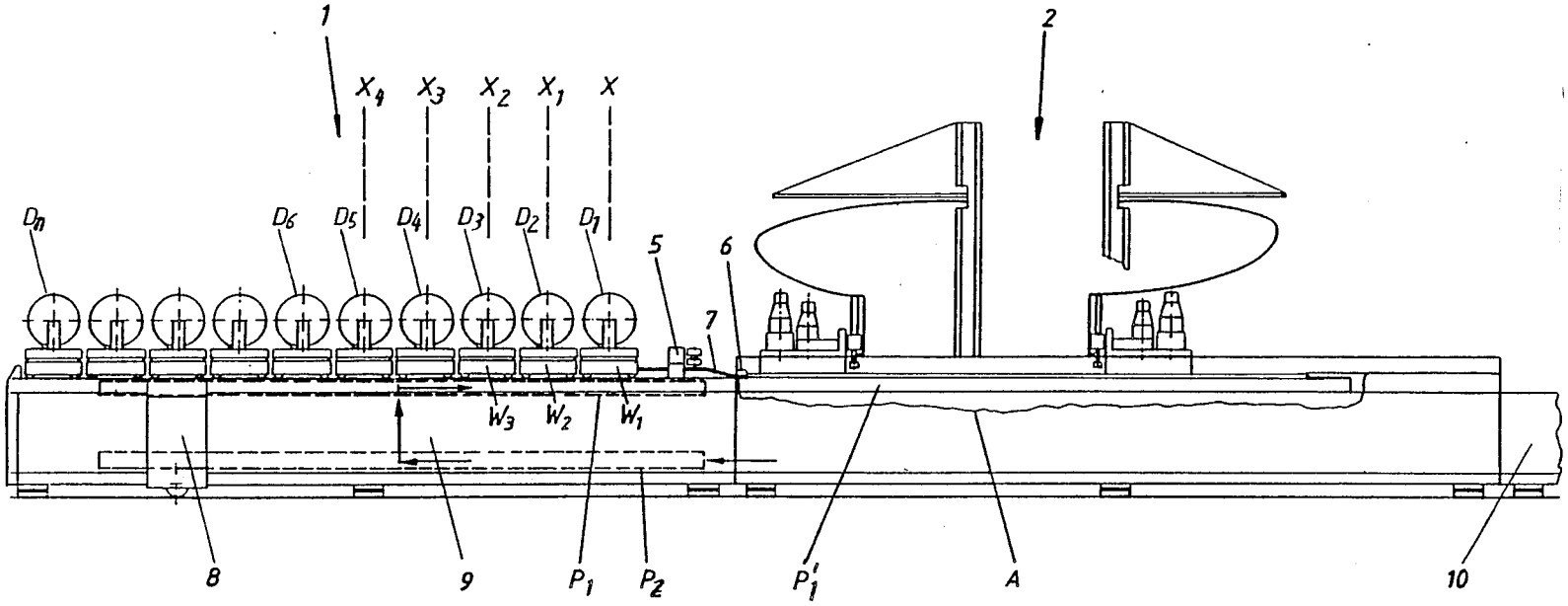
FIG. 1 is a side view of a complete cutting apparatus.

FIG. 1 shows a complete cutting apparatus, which comprises a cutting unit 2, a laying station 9 arranged in front of it (upstream), and a removal station 10 arranged behind it (downstream).

The laying station 9 includes a roll changer 1, several pallets P and a fixed clamping beam 5, as well as one or more carriages $W_1, \ldots, W_n$ which are mounted for longitudinal displacement on rails 3 and 4 above the pallets P and on which a corresponding number of material rolls $D_1, \ldots, D_n$ can be turnably mounted.

The removal station 10 is where the blanks which have been cut out are removed from the cutting apparatus.

The gantry 11 of the cutting unit 2 is provided with an end-position switch (not shown in detail) which is actuated when a pallet P has been brought into the cutting region A and passes said switch.

Figure 2:
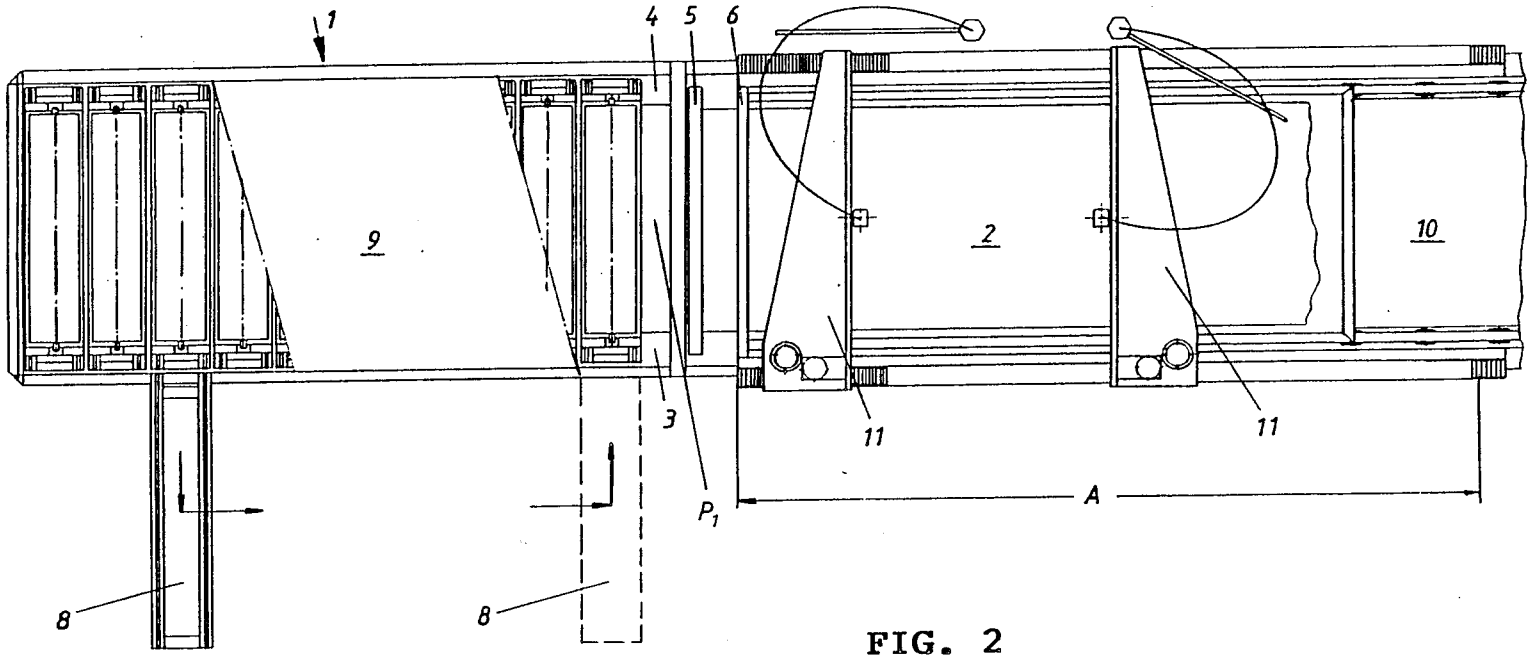
FIG. 2 is a plan view of the cutting apparatus of FIG. 1.

Before the cutting starts, rolls of material D are loaded onto the carriages W in a number corresponding to the desired layer thickness of the web of material 7. First, the material rolls D are turnably mounted on the carriages W. Then the rolls and carriages W are loaded on the roll changer 1 by means of the loading and unloading carriage 8 (FIG. 2).

Also at the beginning of the layout process, pallet $P_1$ is shifted to the right (as seen in FIG. 1), out of the position shown in FIG. 1, until its forward end is below the clamping beam 6. The material on the rolls D is then threaded below the clamping beams 5, 6.

In loading the material to be cut, the roll $D_1$ on the carriage $W_1$ is is loaded at the position X. The carriage $W_1$ is then pushed to the left (as seen in FIG. 1) so that it assumes the position $X_1$, which was unoccupied up to that time, and the loading position X is again free. The loading process described above is repeated with the second roll $D_2$ and carriage $W_2$, and after the second web of material has also passed below the clamping beams 5, 6, the carriage $W_2$ is again pushed to the left (in the drawing), so the loading position X is again free and the positions $X_1$ and $X_2$ are now occupied.

This process is repeated until the clamping beams 5, 6 have beneath them a number of individual webs of material piled one above the other which correspond to the desired layer thickness of the web material 7. Then the clamping beam 6 is lowered, whereby the web of material 7 is clamped onto the pallet $P_1$.

The length of each pallet corresponds to at least the length of the cutting region A. Together with the clamping beam 6 mounted thereon (see FIG. 5), the pallet $P_1$ is transported into the cutting region A, in which connection the web of material 7 is unwound from the rolls D corresponding to the distance the pallet $P_1$ has been moved over. The pallet $P_1$ moves to the location indicated by $P_1'$ in FIG. 1 in the cutting region A.

Figure 4:
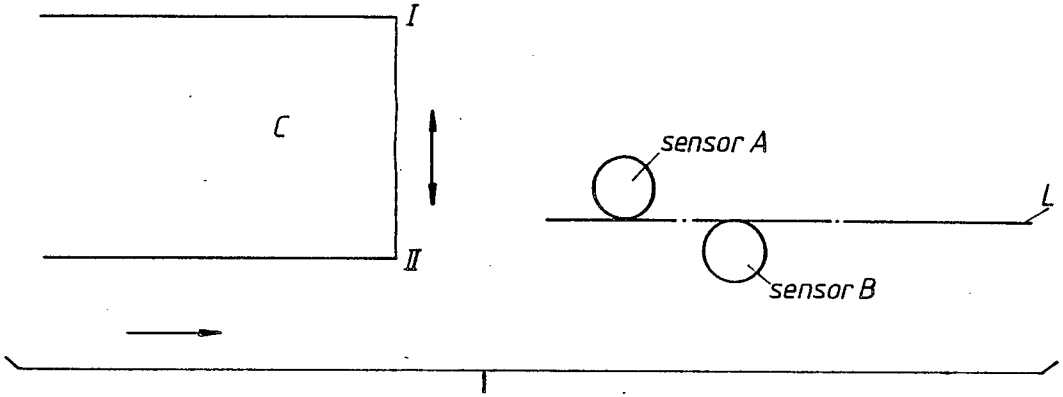
FIG. 4 PRIOR ART
FIG. 4 is a schematic diagram for explaining a known system for sensing and controlling the longitudinal edges of a roll of material.

As the material webs unwind from the rolls D, their longitudinal edges are sensed and controlled by a known edge control system, illustrated schematically in FIG. 4.

When material is wound into a roll, its edges may not precisely coincide from layer to layer, because the material can migrate to the left or right while it is being rolled up. The known method of positioning the edges, which involves sensing one edge, compensates for this rolling error by shifting each carriage $W_1, \ldots, W_n$ to the left or right to ensure that the edge of the material will always coincide with a predetermined straight line.

In FIG. 4, web C is intended to be positioned precisely along line L. Sensor B can detect when web C extends too far in direction II, and the carriage on which the roll of material is mounted on is returned to a corresponding extent in direction I. In the opposite situation, sensor A detects a deviation from line L toward direction I, and the associated carriage W moves in direction II. Each carriage $W_1, \ldots, W_n$ advantageously has its own edge controls. This known edge control system sees to the correct position of the edges of the respective webs in the disclosed embodiment.

Figure 5:
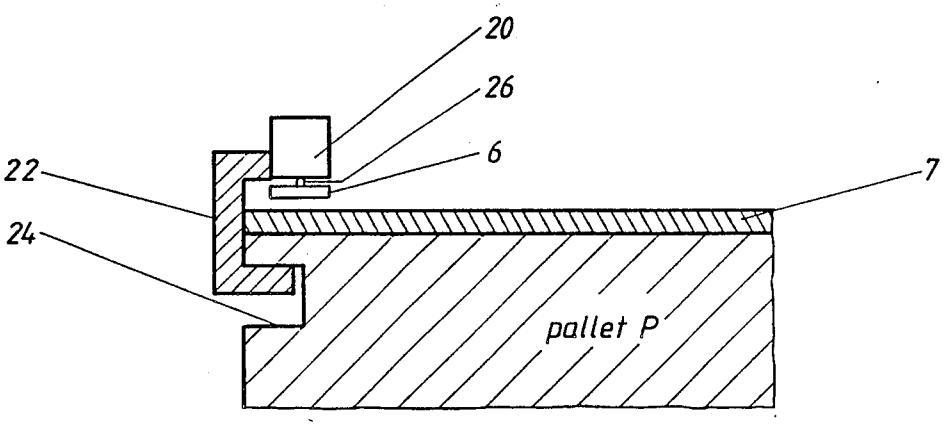
FIG. 5 is a schematic cross-sectional view taken transversely to the pallet P, showing the clamping beam 6 and related elements on the left-hand side of the pallet P only.

An example of an arrangement for the clamping beam 6 is shown in detail in FIG. 5. In this example, the clamping beam 6 is attached to a pneumatic cylinder 20 which in turn is secured to a clamp 22 which engages a groove 24 in the pallet P. When the piston rod 26 moves downward from the cylinder 20, the material 7 is firmly clamped to the pallet P.

By these means, the clamping beam may be secured to the pallet and will be shifted along with it as the pallet moves.

When the pallet $P_1$ has moved to the right (as seen in FIGS. 1–2) and reached its end position $P_1'$, the clamping beam 6 is loosened and moved back into its starting position. In this embodiment, the clamping beam 6 is provided with its own drive mechanism for this purpose, whereby the return motion is automatic. The cutting process can then commence.

Figure 3:
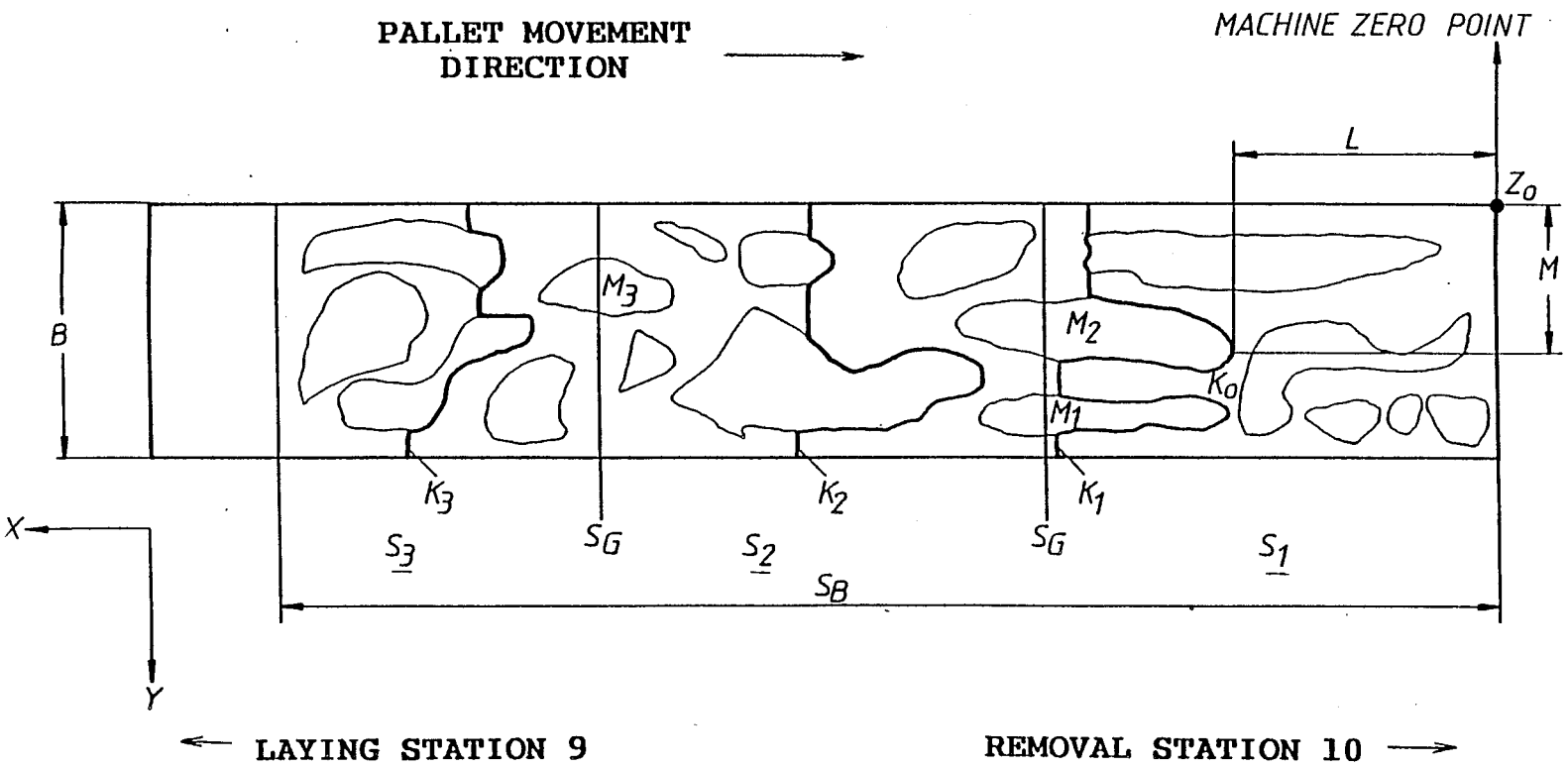
FIG. 3 is a plan view of a pattern to be cut out of a web, wherein the pattern is divided into segments ($S_1$, $S_2$, $S_3$, . . . ) whose size corresponds to the size of the cutting region, and wherein some of the individual contours to be cut out ($M_1$, $M_2$, $M_3$, . . . ) overlap more than one segment.

As shown in FIG. 3, the complete cutting pattern $S_B$ is divided into individual segments S, wherein the lengths of the individual segments S correspond to the length of the cutting region A.

Note that as seen in FIG. 3, the direction of movement of the pallets and the webs is from right to left.

The individual contours to be cut out are so distributed within the overall cutting pattern $S_B$, with due consideration of the corresponding width B of the material, that only minimal waste remains. Possible methods for this purpose are known from Federal Republic of Germany OS 3,627,110.

By the use of the method described herein, it is immaterial whether the contours to be cut extend beyond the segment boundaries $S_G$ or not and correspondingly, whether they are located fully inside or still completely outside the cutting region A when a given pallet is in position for cutting.

The cutting of the contours within segment $S_1$ (five complete contours and two partial contours in this example) is started in the region away from the removal station 10 and towards the laying station 9. A double-gantry system can be used as shown, or a monocutting system can also be used. The web can be controlled for carrying out the cutting by means of an ordinary draw-in control, the individual contour data being stored in the main memory of the control mechanism (Federal Republic of Germany OS 3,627,110 and Federal Republic of Germany AS 2,301,736 show how this can be done).

When the cutting gantry 11 has reached the end of the cutting region A, a cut $K_1$ is effected over the entire width B of the web of material 7 so that the web is separated from the rolls. This cut $K_1$ is generally not effected linearly but—as shown in FIG. 3—follows the contours (within the segment being cut) defining those blanks which lie partially within the cutting region A but also extend beyond the corresponding boundary of the segment S being cut at the time. For example, the cut $K_1$ follows the partial contours within segment $S_1$ of the blanks $M_1$ and $M_2$, which extend out of segment $S_1$ and into segment $S_2$, and correspondingly are not fully within the cutting region A.

It is not absolutely necessary to effect the cut $K_1$ at or near the end of the cutting region; rather, as shown in the case of segment $S_2$ in FIG. 3, the cut $K_2$ can also be effected in the middle of the cutting region A, provided that no subsequent cut over the entire width B should be required, due to the optimized pattern layout.

For this purpose a suitable control program is provided, the development of which is within the skill of the ordinary software designer.

Accordingly, patterns M1, M2, M3, which extend over two adjacent segments S, are initially only partially cut out. After this, the NC-controlled cutting gantry 11 moves back to the x-coordinate L which corresponds to the point $K_0$, which is the point at which the partially cut-out patterns $M_1$ and $M_2$ extend furthest into the cutting region A toward the removal station 10. This is done, as will be explained further below, so that the pallet $P_2$ can be brought under the partially cut contours.

The stationary clamping beam 5 is lowered onto the web of material 7 which is still attached to the rolls D, so that the web of material is held fast on the laying station 9. The following pallet $P_2$ is transported so far forward that it almost strikes against the pallet $P_1$ which is present at position $P_1'$ in the cutting region A. By fixing the web of material 7 in place by means of the clamping beam 5, it is assured that folds will not form upon contact with the pallet $P_2$. Both pallets $P_1$ and $P_2$ are moved with the same speed to the right (as seen in FIGS. 1 and 2) until the pallet $P_2$ passes the end switch (not shown) which is present on the cutting gantry 11 (which is still at the location L where the partially cut-out contours extend farthest into segment $S_1$ toward the removal station 10) and further transport is interrupted. It is now assured that all partially cut-out contours (such as $M_1$ and $M_2$) have come to lie completely on the pallet $P_2$.

The clamping beam 6 is then lowered while the stationary clamping beam 5 is loosened, whereby the web of material 7 is fixed on the pallet $P_2$. Both pallets $P_1$ and $P_2$ are transported further until pallet $P_1$ arrives completely at the removal station 10 and pallet $P_2$ has arrived fully in the cutting region A. The cutting gantry 11 is shifted to the left (FIG. 3) by the same amount. Then the clamping beam 6 is loosened and returns to its starting point. As mentioned above, the clamping beam 6 can be provided with its own drive, which operates in synchronism with the feed device.

Once curve $K_1$ has been cut, the pallets move toward the removal station 10 (toward the left in FIG. 3; toward the right in FIGS. 1 and 2), but only far enough to continue the cutting of the partially cut-out pieces $M_1$ and $M_2$ whereby they are then completely cut. The x-coordinate of point $K_0$ shifts simultaneously, but not the y-coordinate.

When the pallet $P_2$ is moved into the cutting region A, the cutting gantry 11 is also moved to the left (FIG. 3) by the same amount to allow cutting to continue.

The cutting gantry 11 can thereby travel to the place where the pattern is already partially cut and can carry out further cutting by again proceeding from the direction of the removal station 10 towards the laying station 9. At the end of such further cutting, another cut $K_2$ is again carried out over the complete width B of the web of material 7, within segment $S_2$, and the process previously described is started again.

During the cutting program, the blanks which have been cut out can be removed at the removal station 10.

The machine zero point $Z_0$ shown in FIG. 3 is an arbitrary point associated with the cutting region A. It is stored in the electronic controls, and all parameters (curve coordinates, motion of the cutting tool, etc.) of the cutting method and apparatus are derived from it. In the embodiment of FIG. 3, the machine zero point is at a corner of the cutting region A toward the removal station 10.

In FIG. 3, the point $K_0$ is precisely prescribed to be spaced a distance L behind the machine zero point $Z_0$. Point $K_0$ represents the furthest penetration of the cutting tool toward the removal station 10, into the cutting area A, once the curve K has been cut. The coordinates of the point $K_0$, are (L, M) in the example of FIG. 3.

Once it has been defined, an appropriate software program will be able to convert the coordinates (x,y) of the position $K_0$ into new coordinates (x', y), and the cutting gantry 11 or, better, the cutting nozzle can initially be shifted to that point in order to leave enough space in cutting area A to bring another pallet $P_2$ up to the end of pallet $P_1$ and then shift both pallets toward removal station 10 at the same speed.

In another embodiment of the invention, it is also possible to effect the transport of the pallets P from the removal station 10 to the laying station 9 below the cutting apparatus so that continuous rotation of at least four pallets can take place, which further reduces the cycle time of the process.

Although the invention has been described with respect to specific embodiments thereof, the appended claims are not so limited, but are to be construed as embodying all modifications and variations that may occur to one of ordinary skill in the art and that fairly fall within the teachings of the present disclosure.

What is claimed is:

1. An apparatus for cutting out blanks from a web of material, comprising:

a cutting unit;

roll supporting means upstream from the cutting unit for rotatably supporting a plurality of rolls of material which corresponds to a desired layer thickness of the web of material to be cut;

said roll supporting means including respective carriages for rotatably mounting said rolls, which carriages are mounted to be individually longitudinally displaceable upstream and downstream in a roll supporting area;

said roll supporting means further comprising a roll changer which is operable to remove a carriage from any longitudinal location in said roll supporting area, and to return it to another longitudinal location in said roll supporting area;

means for accommodating a pallet for being displaceable downstream from said roll supporting means to said cutting unit; and at least a first clamping means between said roll supporting means and said cutting unit, into which the material of each roll can be passed for clamping the material, said first clamping means being operable to clamp said web to a pallet which is arranged upstream from the cutting unit, and being operable to move with said pallet into said cutting unit while continuing to clamp said material.

2. An apparatus according to claim 1, comprising a plurality of pallets accommodated in said apparatus for being displaceable downstream from below said roll supporting means to said cutting unit, each pallet which has been moved into the cutting unit being continuously replaced below said roll supporting means by another pallet.

3. An apparatus according to claim 1, wherein said roll supporting means comprises rails for movably supporting said carriages.

4. An apparatus according to claim 1, wherein the roll changer includes at least one loading and unloading device which is mounted displaceably for being moved in the upstream and downstream directions along the longitudinal side of the roll supporting means.

5. An apparatus for cutting out blanks from a web of material, comprising:

a cutting unit;

roll supporting means upstream from the cutting unit for rotatably supporting a plurality of rolls of material which corresponds to a desired layer thickness of the web of material to be cut;

said roll supporting means including respective carriages for rotatably mounting said rolls, which carriages are mounted to be individually longitudinally displaceable upstream and downstream in a roll supporting area;

said roll supporting means further comprising a roll changer which is operable to remove a carriage from any longitudinal location in said roll supporting area, and to return it to another longitudinal location in said roll supporting area, and;

means for combining material from said plurality of rolls to form said web of material to be cut, and for disposing said web at said cutting unit.

* * * * *